United States Patent [19]

Kageyama et al.

[11] Patent Number: 4,836,703

[45] Date of Patent: Jun. 6, 1989

[54] LEAD CARTRIDGE OPENING AND CLOSING UNIT

[75] Inventors: Hidehei Kageyama; Yoshihide Mitsuya; Saburo Kobayashi, all of Kawagoe, Japan

[73] Assignee: Kotobuki & Co., Ltd., Kyoto, Japan

[21] Appl. No.: 61,293

[22] Filed: Jun. 12, 1987

[30] Foreign Application Priority Data

| | | | |
|---|---|---|---|
| Aug. 29, 1986 | [JP] | Japan | 61-204692 |
| Dec. 29, 1986 | [JP] | Japan | 61-199672 |
| Dec. 29, 1986 | [JP] | Japan | 61-199673 |

[51] Int. Cl.[4] ..... B43K 21/00

[52] U.S. Cl. ..... 401/65; 401/85; 401/89

[58] Field of Search ..... 401/85, 89, 90, 57, 401/65, 67, 56, 63, 86; 221/307, 310

[56] References Cited

U.S. PATENT DOCUMENTS

| | | | |
|---|---|---|---|
| 1,889,963 | 12/1932 | Cooney et al. | 221/310 |
| 3,854,625 | 12/1974 | Kuebler | 221/307 X |
| 4,659,242 | 4/1987 | Katz | 401/90 X |

FOREIGN PATENT DOCUMENTS

| | | | |
|---|---|---|---|
| 0202942 | 11/1986 | European Pat. Off. | 401/85 |
| 3401647 | 1/1986 | Fed. Rep. of Germany | 401/85 |
| 54-51052 | 4/1979 | Japan | 401/89 |

*Primary Examiner*—Richard J. Apley

*Assistant Examiner*—Franklin L. Gubernick

*Attorney, Agent, or Firm*—Sherman and Shalloway

[57] ABSTRACT

A lead cartridge opening and closing unit wherein outward engaging piece portions are provided on a chuck type opening and closing mechanism which is divided into sections in the diametrical direction and has inward elastic force and which is further disposed on the lead cartridge; the outward engaging piece portions moving inwardly against the inward elastic force along the diametrical direction thereof thereby to open lead conducting holes in case of forcible insertion into and engagement with a lead guide, while the outward engaging piece portions being restored by means of the inward elastic force to move outwardly along the diametrical direction thereof thereby to close the lead conducting holes in case of release for the forcible insertion and engagement; whereby when the outward engaging piece portions of the chuck type opening and closing mechanism are forcibly fitted in the lead guide, the outward engaging piece portions move inwardly along the diametrical direction thereof to be resiliently fitted to and engaged with the lead guide so that the lead conducting holes are opened, and on the other hand when the outward engaging piece portions are drawn out from the lead guide, these outward engaging piece portions are restored outwardly by means of the inward elastic force along the diametrical direction thereof so that the lead conducting holes are closed.

2 Claims, 11 Drawing Sheets

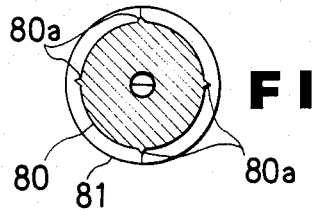
FIG. 10
FIG. 7
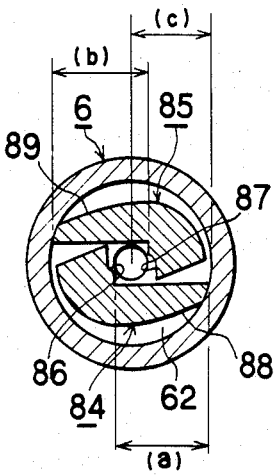
FIG. 8
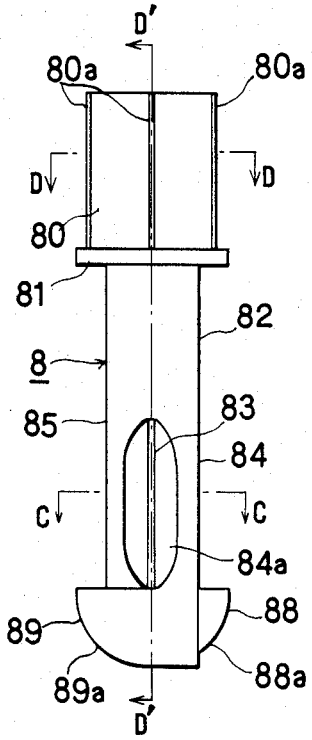
FIG. 11
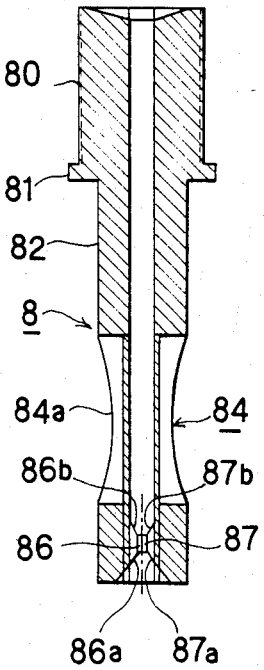
FIG. 6
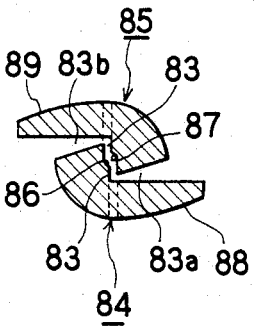
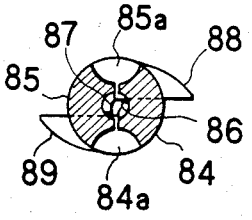
FIG. 9

LEAD CARTRIDGE OPENING AND CLOSING UNIT

BACKGROUND OF THE INVENTION

1. Field of the Invention

This invention relates to a lead cartridge opening and closing unit in cassette type mechanical pencils.

2. Description of the Prior Art

Recently, a so-called cassette type mechanical pencil was developed by means of which the lead members used can be exchanged and/or supplied by, for example, exchanging a whole cartridge 101 thereof in which writing lead members are contained as shown in FIG. 1. Such exchange may be accomplished without refilling such lead members one by one so that staining of a user's hands by a lead member is avoided.

In such a conventional cassette type mechanical pencil, the lead cartridge 101 is simply provided with a cap 102 at the extreme end thereof. In this connection, exchange and/or supply of lead members for a mechanical pencil has been conducted in such a manner that the end cap 102 is first removed from the cartridge to throw away the cap, and the extreme end of the lead cartridge is fitted in an outer cylinder 103 of the mechanical pencil in its open state as shown in FIG. 2.

Accordingly, there has been such a problem that when the lead cartridge is inclined in even a slight degree after removing the end cap 102, the lead members 104 move out of the lead cartridge 101 and they fall off the lead cartridge.

As a result, it is necessary to insert the lead cartridge 101 into the outer cylinder 103 while always maintaining the lead cartridge 101 in an upward orientation.

Furthermore, in the case where the lead cartridge 101 is released from the outer cylinder 103, there has been also such a problem that when the lead members 104 are inclined downwardly in even a slight degree, the lead members 104 move out of the lead cartridge so that they remain in the outer cylinder 103.

Moreover, a conventional cassette type mechanical pencil has such a construction that the lead cartridge 101 containing a number of lead members 104 is contained in the outer cylinder 103 together with a lead guide 105 for detachably inserting the lead cartridge 101 thereinto as shown in FIG. 2. In such construction as described above, provision of a tapered beveled portion 107 is required on the inner surface of the extreme end of the lead cartridge 101 for capturing remaining lead members in the outer cylinder 103. In addition, the inner wall of the outer cylinder 103 is required to form into an inside protuberant wall portion 106 different in level from the inner wall of the outer cylinder 103 as shown in FIG. 2. For this reason, there has been a problem in that the diameter of the lead cartridge is restricted because of the existence of the inside protuberant wall portion 106, so that capacity for containing lead members decreases. in these circumstances, since application of extrusion molding to the outer cylinder 103 provided with the protuberant wall portion 106 as mentioned above is impossible, injection molding must be applied in this case where the metallic mold for the latter molding operation becomes more expensive than that of the former molding procedure and this also results in another problem.

In this respect, the present applicant has attained the elimination of the above described problems by means of the opening and closing unit for the lead cartridge disclosed in Japanese Patent Publication No. 204692/1986 which was previously filed by the present applicant.

In the opening and closing unit for the lead cartridge according to the above identified prior application, a forwardly and extensively protruded chuck type opening and closing unit from the extreme end of its lead cartridge has been described. However, such forward and extensive protrusion of the chuck type opening and closing mechanism as described above makes the appearance thereof unfavorable. Moreover, there has been still a problem in that the whole length of the lead cartridge becomes longer by the protruded length of the above described chuck type opening and closing mechanism, whereby the whole shaft length of a mechanical pencil to which said lead cartridge is applied becomes longer.

SUMMARY OF THE INVENTION

The principal object of the present invention is to provide a useful opening and closing unit for lead cartridge which eliminates disadvantages of the conventional unit as described above.

It is another object of the present invention to provide an opening and closing unit wherein lead conducting holes are opened in only the case when a lead cartridge is forcibly inserted into and engaged with a writing utensil for exchanging and supplying lead members, whilst the lead conducting holes are closed in case of releasing the forcible insertion and engagement of the lead cartridge to prevent the slipping of lead members off from the cartridge when the cartridge is being exchanged.

It is a further object of the present invention to provide an opening and closing unit for lead cartridge which eliminates parts to be discarded such as a cap and the like for the cartridge, and wherein extrusion molding becomes applicable for the outer cylinder of a writing utensil. The capacity of the lead cartridge for containing lead members can be increased by the adoption of the present opening and closing unit.

It is a still further object of the present invention to provide an opening and closing unit for lead cartridge wherein a chuck type opening and closing mechanism only barely projects from the extreme end of the lead cartridge so that the appearance of the lead cartridge is improved. Further, the lead cartridge is not longer by a length corresponding to that of said chuck type opening and closing unit.

BRIEF DESCRIPTION OF THE DRAWING FIGURES

FIG. 6 is a sectional view taken along the line A—A of FIG. 4;

FIG. 7 is a sectional view taken along the line B—B of FIG. 5;

FIG. 8 is a side view showing a chuck type opening and closing unit according to the first example of the present invention;

FIG. 9 is a sectional view taken along the line C—C of FIG. 8;

FIG. 10 is a sectional view taken along the line D—D of FIG. 8;

FIG. 11 is a sectional view taken along the line D'—D' of FIG. 8;

DETAILED DESCRIPTION OF THE INVENTION

A first example of the present invention will be described hereinbelow by referring to the accompanying drawings.

Figure 3:
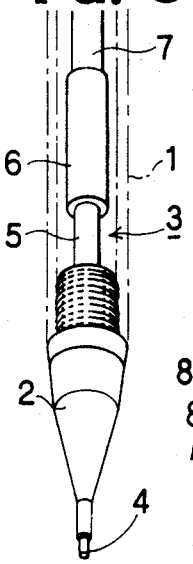
FIG. 3 is a schematic perspective view showing a cassette type mechanical pencil according to an example of the present invention.

In FIG. 3, reference numeral 1 designates an outer cylinder of a mechanical pencil, 2 a forward implement screwed to the extreme end of the outer cylinder 1, and 3 a part of a lead feeding mechanism placed in the outer cylinder 1, respectively, the lead feeding mechanism 3 being provided with a lead chuck 5 for fastening a lead member 4, and a lead guide 6 being meshed with the rear end of the lead chuck 5. In this case, a chuck coupler may be, of course, added between the lead chuck 5 and the lead guide 6.

Figure 4:
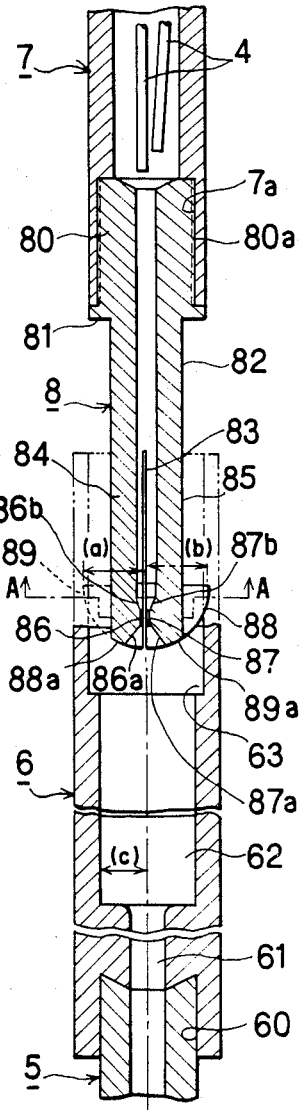
FIG. 4 is a sectional view showing essential parts for attaching a lead cartridge in the mechanical pencil of FIG. 3 before assembling the parts.
Figure 5:
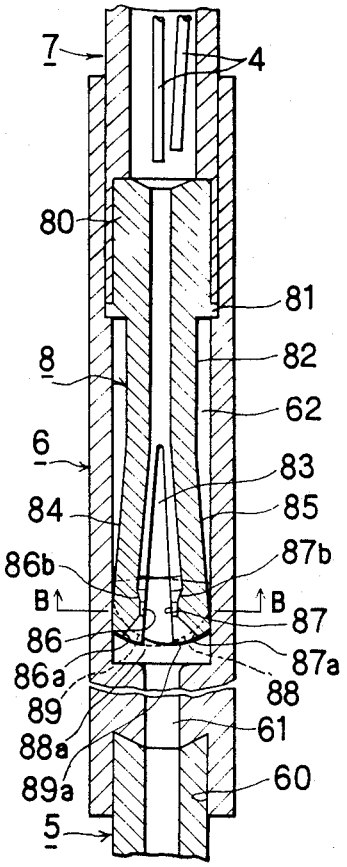
FIG. 5 is a sectional view showing the essential parts for attaching a lead cartridge after assembling them.
Figure 14:
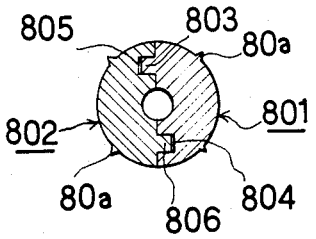
FIG. 14 is a sectional view taken along the line E—E of FIG. 12.

As shown in FIGS. 4 and 5, said lead guide 6 consists of a front side cylindrical portion 60, a rear side outer cylindrical portion 61 having a stepped larger diameter and extended coaxially from the rear end portion of said front side cylindrical portion 60 towards the rear, and a rear side inner cylindrical portion 62 extending into said rear side outer cylindrical portion 61 by integrally aligning the same with the rear end portion of said front side cylindrical portion 60.

Such lead guide 6 has a function for feeding a lead member 4 to the lead chuck 5 one by one. A front side fitting hole 63 into which the rear end portion of said lead chuck 5 is fitted is defined in the shaft center of the front side cylindrical portion 60 at the front end side thereof. Said front side cylindrical portion 60 and said rear side inner cylindrical portion 62 define coaxially a lead a lead feeding hole 64 communicating with said front side fitting hole 63 and having an inner diameter through which only one lead member can be fed. Furthermore, said rear side outer cylindrical portion 61 defines an annular fitting gap portion 65 with which is detachably meshed the front end side of lead cartridge 7 between said rear side outer cylindrical portion 61 and said rear side inner cylindrical portion 62. Moreover, a tapered portion **62*a* having such diameter which becomes gradually smaller towards the rear end side thereof is defined on the rear end portion of said rear side inner cylindrical portion 62 and on which is smoothly mounted the front end side of the chuck type opening and closing mechanism 8** discussed hereinbelow.

The lead cartridge 7 is detachably meshed and connected with the lead guide 6 through the chuck type opening and closing mechanism 8.

The opening and closing mechanism 8 according to the first example of the present invention has a rear side cylindrical portion 80 the rear side of which is fitted into a larger diameter hole portion 7*a* at the extreme end of the lead cartridge 7. In this case, a plurality of axially disposed ribs 80*a* which are integrally placed protrusively on the outer circumferential surface of the rear side cylindrical portion 80 is forced against and engaged with the inner circumferential surface of the extreme end larger diameter hole portion 7*a* as shown in FIG. 4 and FIGS. 8–10.

Furthermore, an outer circular protuberant portion 81 is integrally formed on the extreme end of the rear side cylindrical portion 80 in the form of a stepped larger diameter.

The outer circular protuberant portion 81 abuts against the extreme end of the lead cartridge 7.

A front side cylindrical portion 82 having a stepped smaller diameter is integrally aligned to the front end of the outer circular protuberant portion 81 in a coaxial manner.

Elastic opening and closing piece portions 84 and 85 are divided into two sections by a slit 83 extending from a substantially intermediate portion to the front end of the front side cylindrical portion 82 along the diametrical direction thereof. These are integrally formed on said front side cylindrical portion 82 as shown in FIGS. 4, 5, 8 and 11, respectively.

These elastic opening and closing piece portions 84 and 85 have inward elastic force and are expandable and reducible in the diametrical direction on a shaft center portion of which are defined half lead conducting holes 86 and 87. Each has a symmetrically semicircular arcuate shape which is divided by said slit 83 into two sections, on the front end side of the elastic opening and closing piece portions.

The half lead conducting holes 86 and 87 are arranged to form such inner diameter that lead members 4 having different diameters become conductible in the case of elastic deformation of the elastic opening and closing piece portions 84 and 85 towards the direction for expanding the diameter thereof. While lead member 4 having the minimum diameter becomes unconductible in the case of elastic deformation of said elastic opening and closing piece portions 84 and 85 towards the direction for reducing the diameter.

Under normal conditions the elastic opening and closing piece portions 84 and 85 are closed by means of inward elastic force so as to mutually define the minimum diameter while reducing the diameter.

More specifically, two types of the opening and closing mechanism according to the present example are constructed dependent upon a diameter or diameters of lead members 4 to be used.

(1) Use of the lead members 4 having the same diameter as one another:

The half lead conducting holes 86 and 87 are opened in such that a single type of lead member 4 having each one diameter of, for example, 0.5 mm, 0.7 mm, 0.9 mm, can only be conducted through the resulting opening in the case when the undermentioned outward engaging piece portions 88 and 89 of the elastic opening and closing piece portions 84 and 89 are forcibly put in and engaged with a chuck containing hole 62 of the lead guide 6.

(2) Use for both lead members having different diameters (for example, 0.5 mm and 0.7 mm):

The half lead conducting holes 86 and 87 are formed changeably such that they occupy a space through which either of the lead members 4 can be conducted in the case when the outward engaging piece portions 88 and 89 are put in and engaged with the chuck containing hole 62, while the half lead conducting holes 86 and 87 takes a space through which both the lead members having different diameters cannot be conducted during the forcible insertion and engagement.

Half forwardly tapered holes 86*a* and 87*a* are defined on the forward ends of such half lead conducting holes 86 and 87 as described above, and the diameters of these half forwardly tapered holes 86*a* and 87*a* become gradually larger on the mutual front end sides thereof, as shown in FIGS. 4, 5 and 11.

Furthermore, half rearwardly tapered holes 86*b* and 87*b* are defined on the rear ends of said half lead conducting holes 86 and 87, and the diameters of these half rearwardly tapered holes 86*b* and 87*b* become gradually larger on the mutual rear end sides thereof.

Outward engaging piece portions 88 and 89 which extend oppositely to each other are integrally formed on the front end sides of said elastic opening and closing piece portions 83 and 84.

More specifically, said slit 83 separates the half lead conducting holes 86 and 87 from one another on the front end sides of said elastic opening and closing piece portions 84 and 85 while keeping a way from said outward engaging piece portions 88 and 89, respectively, as shown in FIGS. 6 and 7.

Slits 83*a* and 83*b* which stand on different levels from each other and are connected with the opposite ends of slit 83 along the inside surfaces of the outward engaging piece portions 88 and 89 are defined on said elastic opening and closing piece portions 84 and 85 at the front end sides thereof.

Accordingly, portions for shaping the outward engaging piece portions 88 and 89 on the front end sides of the elastic opening and closing piece portions 84 and 85 are separated by said slits 83, 83*a*, and 83*b* on different levels from each other.

As a result, the outward engaging piece portion 88 of one of the elastic opening and closing piece portions, i.e. the portion 84 projects outwardly from the outer circumferential surface of the other elastic opening and closing piece portion 85, while the outward engaging piece portion 89 of the elastic opening and closing piece portion 85 projects outwardly from the outer circumferential surface of the other elastic opening and closing piece portion 84.

In this case, said outward engaging piece portions 88 and 89 are formed such that each length (a) and (b) defined between the extreme end of either portions 88 and 89 and each of their shaft center portions is longer than a radius (c) of the chuck containing hole 62 as shown in FIGS. 4 and 7.

Forward circular arcuate surfaces 88*a* and 89*a* are formed on the front of the respective outward engaging piece portions 88 and 89 as shown in FIGS. 4, 5 and 8, whereby said outward engaging piece portions 88 and 89 can easily be forcibly put in the chuck containing hole 62 of said lead cartridge 7 by means of these forward circular arcuate surfaces 88*a* and 89*a*.

Specifically, the respective outward engaging piece portions 88 and 89 are forcibly inserted into the chuck containing hole 62 through the rear fitting hole 63 of the lead guide 6 in the usual condition where said elastic opening and closing piece portions 84 and 85 are deformed elastically by their respective inward elastic force along the direction of reducing the diameter to close both the half lead conducting holes 86 and 87 as shown in FIGS. 4, 6, 8 and 9.

As a result of the above forcible insertion, each of the outward engaging piece portions 88 and 89 moves along the direction in passing each other as shown in FIGS. 4 and 7, and both of the elastic opening and closing piece portions 84 and 85 are elastically deformed integrally with their outward engaging piece portions 88 and 89 along the direction of expanding the diameter, so that the half lead conducting holes 86 and 87 are opened. In this case, said outward engaging piece portions 88 and 89 are resiliently fitted to and engaged with the chuck containing hole 62 of the lead guide 6, whereby the lead cartridge 7 is slipped in and set to the lead guide 6 through the opening and closing mechanism 8.

Furthermore, gouged portions 84*a* and 85*a* each having a semicircular arcuate profile in its section are defined on the outer circumferential surfaces of said elastic opening and closing piece portions 84 and 85 extending over both the portions thereof as shown in FIGS. 8, 9 and 11.

As a result of the provision of these gouged portions 84*a* and 85*a*, the elastic opening and closing piece portions 84 and 85 become thinner in their diametrical directions, respectively, whereby they are easily deformed elastically so that resilient fitting and engagement as well as the release of both the opening and closing piece portions 84 and 85 are carried out smoothly with respect to the chuck containing hole 62 of the lead guide 6. It is to be noted that said gouged portions 84*a* and 85*a* are not indispensable elements.

In operation, the lead cartridge 7 meshed with the lead guide 6 is drawn out with the opening and closing mechanism 8 in case of exchanging lead members or confirming the presence of lead members during the use of a mechanical pencil.

In this case, the resilient fitting and engagement of the outward engaging piece portions 88 and 89 of the opening and closing mechanism 8 are released with respect to the chuck containing hole 62, whereby each of the elastic opening and closing piece portions 84 and 85 is deformed elastically by means of its own inward elastic force in the direction of reducing the diameter. As a result, both the half lead conducting holes 86 and 87 are automatically closed until the closing diameter reaches that through which a lead member 4 cannot be conducted. In other words, when a lead member 4 having a diameter of 0.5 mm or more is used, both the holes are closed so as to have a closing diameter of 0.5 mm or less.

Thus, the lead members 4 in the lead cartridge 7 cannot slip from the end opening thereof into the outer cylinder 1 nor can the lead members 4 drop outside the outer cylinder 1.

Moreover, since the lead members cannot slip it is not necessary to provide a beveled portion such as a tapered portion or the like on the extreme end inner surface of the lead cartridge 7. As a consequence, there is not the problem of an insufficient flow of resin due to a thin thickness of the extreme end inner surface in case of molding the lead cartridge 7 from a manufacturing point of view.

In addition, there is no need to provide an inside protuberant portion in the outer cylinder 1 as in a conventional mechanical pencil. Therefore, the outer cylinder 1 may be obtained with inexpensive extrusion molding. In addition, a diameter of the lead cartridge 7 can be made larger so that a lead containing capacity can be significantly increased.

Furthermore, if a lead member 4 remains in an area extending over the lead feeding hole 61 of the lead guide 6 and the half lead conducting holes 86 and 87 of the opening and closing mechanism 8, the remaining lead member 4 is chucked with the elastic opening and closing piece portions 84 and 85 to be drawn out, and such chucking operation is due to the elastic deformation of the elastic opening and closing piece portions 84 and 85 in the direction of reducing the diameter by means of release for resilient fitting and engagement of the outward engaging piece portions 84 and 85 in the case of removal of the opening and closing mechanism 8.

Under these circumstances, when either the lead member 4 is taken out from the half lead conducting holes 86 and 87 after the lead cartridge 7 is drawn out or the lead member 4 is pushed into a the lead cartridge 7, there is no breakage of the remaining lead member 4 at the time of exchanging the lead cartridge 7, or clogging of the lead guide 6 with the broken lead member 4.

Thus, when a fresh lead cartridge 7 is pushed into the rear end of the outer cylinder 1, the outward engaging piece portions 88 and 89 of the opening and closing mechanism 8 are forcibly fitted in the rear side cylindrical portion 61 to be resiliently fitted and engaged, whereby the half lead conducting holes 86 and 87 of the opening mechanism 8 are opened as mentioned above, so that supply of the lead members 4 becomes possible.

As described above, while exchanging the lead cartridge 7, the half lead conducting holes 86 and 87 are closed before the outward engaging piece portions 88 and 89 are inserted into the chuck containing hole 62. Hence, there is no springing out of the lead members 4 from the lead cartridge 7 as in a conventional lead cartridge. Moreover, it is not necessary for inverting a mechanical pencil and conducting lead-exchanging operation in an inverted state while maintaining upwardly the lead cartridge 7. Thus, the operation for exchanging the lead cartridge 7 can be easily carried out irrespective of the orientation of the mechanical pencil.

Particularly, in the opening and closing mechanism 8, since the elastic opening and closing piece portions 84 and 85 which are divided into plural sections, respectively, are provided with the outward engaging piece portions 88 and 89 and are openable and closable in the diametrical direction thereof through these outward engaging piece portions 88 and 89, a fresh lead cartridge 7 containing either lead members 4 each having only the identical diameter with each other or lead members 4 having different diameters one another is attached to the lead guide 6 in accordance with the procedure as mentioned above, whereby these lead members 4 can be supplied.

In other words, in the opening and closing mechanism 8, when the elastic opening and closing piece portions 84 and 85 are opened and closed through the outward engaging piece portions 88 and 89, the degree of opening and closing is adjusted, so that the opening and closing mechanism 8 can be used for both the lead members 4 each having only the identical diameter with each other and lead members 4 having different diameters from one another.

An opening and closing mechanism 8 according to the second example of the present invention is shown in FIGS. 12–22.

This opening and closing mechanism 8 according to the second example has a construction of which the whole is divided into two sections in the diametrical direction along the axis thereof.

More specifically, a rear side cylindrical portion 80 consists of half cylindrical portions 801 and 802 which are obtained by dividing the former into two sections along the axis thereof.

In the case when these half cylindrical portions 801 and 802 are forcibly put in an extreme end larger diameter hole portion *7a* in a lead cartridge 7, shown in FIGS. 3–5, these half cylindrical portions 801 and 802 are concentrically assembled and incorporated, and in this case, both of the portions are constructed such that they are positively engaged with and fitted to each other at the time of their assemblage and incorporation.

As the engaging means for assembling and incorporating the half cylindrical portions 801 and 802, an engaging convex portion 803 and an engaging concave portion 804 are integrally formed on either surface of the mating face composed of the half cylindrical portions 801 and 802, while an engaging concave portion 805 corresponding to said engaging convex portion 803 and an engaging convex portion 806 corresponding to said engaging concave portion 804 are integrally formed on the other surface of said mating face as shown in FIGS. 12, 14, 15 and 17.

Accordingly, when the engaging convex portion 803 as well as the engaging concave portion 804 of either half cylindrical portion 801 is fitted to and engaged with the engaging concave portion 805 as well as the engaging convex portion 806 of the other half cylindrical portion 802, respectively, both said half cylindrical portions 801 and 802 are exactly assembled and incorporated without any dislocation of them along the axial direction thereof. Thus, according to the second example of the present invention, assemblage of the opening and closing mechanism 8 as well as fitting and setting thereof can be simply carried out with respect to the lead cartridge 7.

Figure 17:
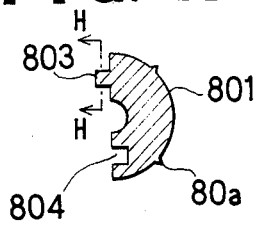
FIG. 17 is a sectional view taken along the line G—G of FIG. 15.
Figure 15:
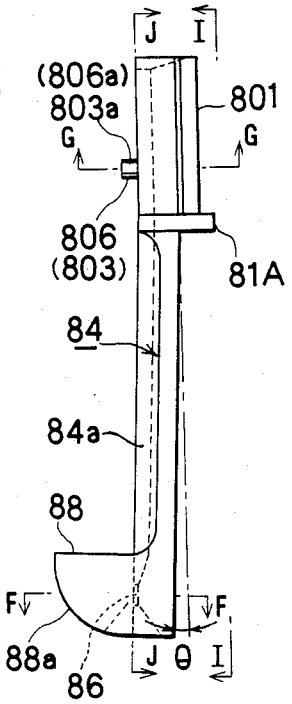
FIG. 15 is a side view showing either chuck type opening and closing mechanism of FIG. 12.
Figure 18:
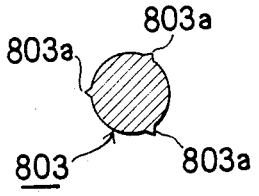
FIG. 18 is a sectional view taken along the line H—H of FIG. 17.
Figure 19:
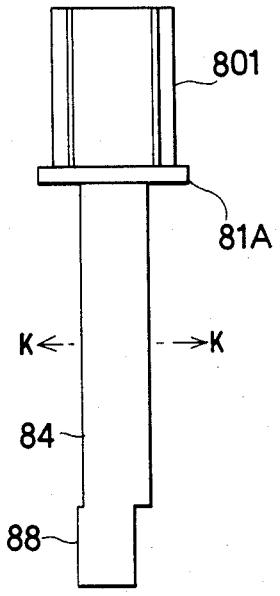
FIG. 19 is a view in the direction of the arrow I—I in FIG. 15.
Figure 22:
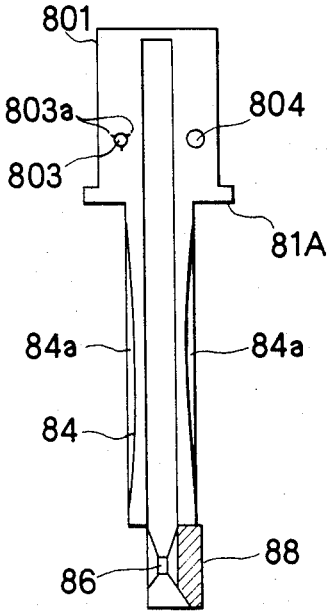
FIG. 22 is a sectional view taken along the line J—J of FIG. 15.
Figure 20:
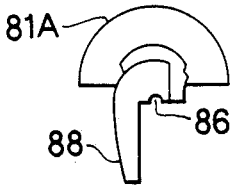
FIG. 20 is a left side end view of FIG. 19.
Figure 21:
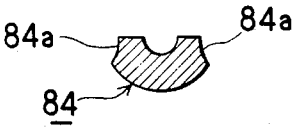
FIG. 21 is a sectional view taken along the line K—K of FIG. 19.

Furthermore, a plurality of engaging ribs 803*a* and 806*a* are integrally formed on the respective outer circumferential surfaces of the engaging convex portions 803 and 806 as shown in FIGS. 15, 17 and 18.

When said engaging convex portions 803 and 806 are fitted in and engaged with said engaging concave portions 804 and 805, these engaging ribs 803*a* and 806*a* are forced against and engaged with the inner circumferential surfaces of these engaging convex portions 803 and 806.

For the above reason, slippage of said engaging convex portions 803 and 806 from said engaging concave portions 804 and 805 is prevented, so that the half cylindrical portions 801 and 802 can be more firmly combined integrally in assembly and incorporation of both whereby accuracy in assemblage of the opening closing mechanism 8 is much improved. Also, the mechanism 8 can be simply and positively fitted and set to the lead cartridge 7. The elastic opening and closing piece portions 84 and 85 can also be smoothly and positively opened and closed.

The elastic opening and closing piece portions 84 and 85 are integrally aligned on the extreme ends of the half cylindrical portions 801 and 802, respectively, through outer semicircular protuberant portions 81A and 81B, each having a stepped larger diameter which are split into two pieces integrally with the half cylindrical portions 801 and 802.

These elastic opening and closing piece portions 84 and 85 have been previously deformed plastically (elastically) by each angle 0-towards the inside along the diametrical direction thereof as in FIG. 15 wherein either of the elastic opening and closing piece portions 84 and 85 is shown.

In these circumstances, when said elastic opening and closing piece portions 84 and 85 are strongly pressed into contact with each other while assembling and incorporating them, both the elastic opening and closing piece portions 84 and 85 can be tightly assembled and incorporated.

Figure 12:
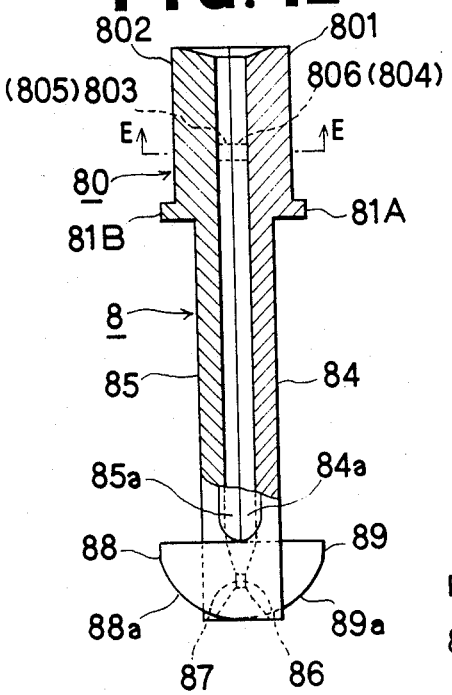
FIG. 12 is a side view, partly sectioned, showing a chuck type opening and closing mechanism according to the second example of the present invention in an assembled and incorporated state.
Figure 13:
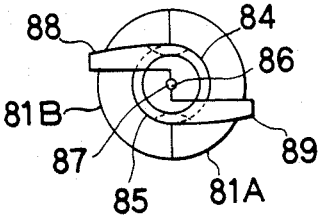
FIG. 13 is a left side end view of FIG. 12.
Figure 16:
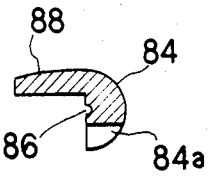
FIG. 16 is a sectional view taken along the line F—F of FIG. 15.

Thus, when outward engaging piece portions 88 and 89 formed integrally on the front end sides of said elastic opening and closing piece portions 84 and 85 and which extend to the opposite sides in the diametrical directions, respectively, as shown in FIGS. 12 and 13 are forcibly put in the lead guide 6 as shown in FIGS. 3–5, these outward engaging piece portions 88 and 89 move in relative directions (the inside along the diametrical directions), and the elastic opening and closing piece portions 84 and 85 move to the outside along the diametrical directions thereof together with the outward engaging piece portions 88 and 89, so that the half lead conducting holes 86 and 87 are opened.

Under these conditions, when the outward engaging piece portions 88 and 89 are drawn out from said lead guide 6, said elastic opening and closing piece portions 84 and 85 are returned flexibly to the inside along the diametrical directions thereof, so that the half lead conducting holes 86 and 87 are opened.

As described above, the elastic opening and closing piece portions 84 and 85 open and close the half lead conducting holes 86 and 87 by means of forcible insertion of the outward engaging piece portions 88 and 89 into the lead guide 6 as well as drawing them out from the lead guide 6. In this case, since the whole of the opening and closing mechanism 8 is split into two pieces as mentioned above, each radius of opening and closing motions in the elastic opening and closing piece portions 84 and 85 becomes larger so that these elastic opening and closing piece portions 84 and 85 are easily subjected to elastic deformation.

In addition, since the elastic opening and closing piece portions 84 and 85 have sufficient flexible returning force due to plastic deformation which has been previously applied to the elastic opening and closing piece portions 84 and 85 inside along the respective diametrical directions as mentioned above, they are smoothly operated. As a result, the fatigue due to repetition of the opening and closing motions decreases.

Moreover, since the whole opening and closing mechanism 8 has been split into two pieces, the outer engaging piece portions 88 and 89 as well as the defined portions of the half lead conducting holes 86 and 87 on the front end sides of the elastic opening and closing piece portions 84 and 85 may be separately formed with standing on different levels at a right angle as shown in FIG. 13.

Thus, the half opening and closing mechanism 8 can simply be molded and the mating face of the half lead conducting holes 86 and 87 can also be tightly and positively joined to each other due to sufficient returning force of the elastic opening and closing piece portions 84 and 85, so that there is no slippage of the lead members 4 in the elastic opening and closing piece portions 84 and 85 and that the lead cartridge 7 will not slip and drop therefrom.

Figure 25:
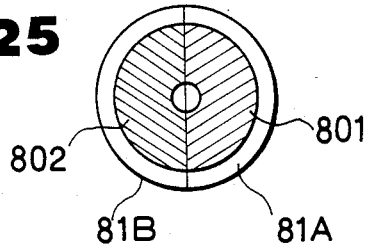
FIG. 25 is a sectional view taken along the line M—M of FIG. 23.
Figure 23:
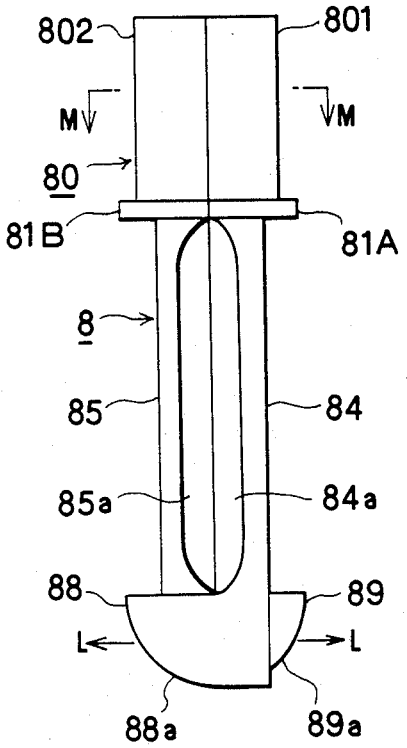
FIG. 23 is a side view showing a chuck type opening and closing mechanism according to the third example of the present invention in an assembled and incorporated state.
Figure 24:
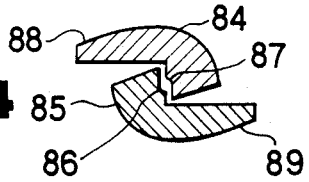
FIG. 24 is a sectional view taken along the line L—L of FIG. 23.

FIGS. 23–25 illustrate the third example according to the present invention wherein the engaging convex portions 803 and 806 as well as the engaging concave portions 804 and 805 in the above second example are omitted. Therefore, a mechanical pencil according to the present third example can be served for use by only assembling and incorporating both of rear side semicircular cylindrical portions 801 and 802 in a concentrical manner, and forcibly putting them in the extreme end hole portion of a lead cartridge 7. According to the third example, a half opening and closing mechanism 8 can more simply be molded than in the case of the second example, and the same functions and advantages can be obtained in respect of opening and closing functions of the elastic opening and closing piece portions 84 and 85 as in the second example.

It is to be noted that the constructions of said second and third examples, other than those described above, are the same as those of the first example, so that like reference numerals designate like or corresponding parts throughout these examples and the explanation therefor will be omitted.

Referring to FIGS. 34–38, the fourth example according to the present invention will be described hereinbelow.

Figure 34:
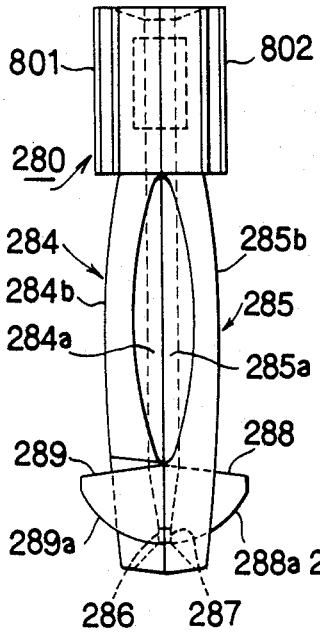
FIG. 34 is a side view showing a chuck type opening and closing mechanism according to the fifth example of the present invention in an assembled and incorporated state.
Figure 36:
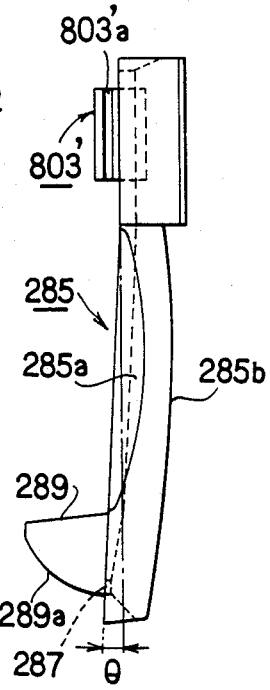
FIG. 36 is a side view showing either chuck type opening and closing mechanism of FIG. 34.
Figure 37:
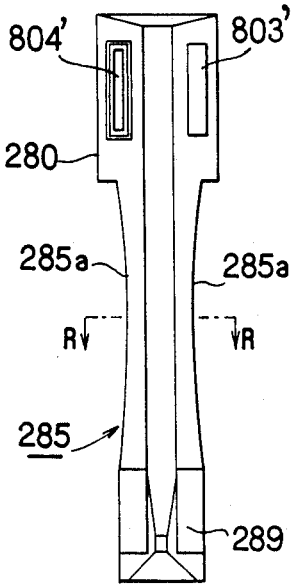
FIG. 37 is a plan view of FIG. 36.

In the fourth example, engaging convex portions 803' and 806' as well as engaging concave portions 804' and 805' are extensively formed along the axial directions, respectively, in the mating face of half cylindrical portions 801 and 802 as shown in FIGS. 34, 36 and 37.

Engaging ribs **804'*a* and 805'*a* are integrally extended from the inner circumferential surfaces of said engaging concave portions 804' and 805', while engaging grooves 803'*a* and 806'*a* for fitting and engaging said engaging ribs 804'*a* and 805'*a* therein and therewith are defined on the outside surfaces of the engaging convex portions 803' and 806'**.

Hence, when the engaging convex portion 803' and the engaging concave portion 804' on either half cylindrical portion 801' are fitted in the engaging concave portion 805' and the engaging convex portion 806' on the other half cylindrical portion 802', respectively, their engaging ribs **804'*a* and 805'*a* are engaged with the engaging grooves 803'*a* and 806'*a*, so that both said half cylindrical portions 801' and 802'** are exactly assembled and incorporated without any dislocation of them in the axial direction thereof.

For the above reason, the engaging convex portions 803' and 806' do not slip from the engaging concave portions 804' and 805'. Both said half cylindrical portions 801' and 802' can be more firmly combined integrally with each other in assembly and incorporation of both of them, and accuracy in assemblage for an opening and closing mechanism 208 is much improved to bring about simple and positive fitting of the mechanism with respect to a lead cartridge 207. In addition, the elastic opening and closing piece portions 284 and 285 mentioned hereinbelow can be smoothly and positively opened and closed.

Furthermore, a wide width engaging projection 807' having a semicircular arc in its profile and a sharpened engaging rib 808' is alternately and integrally extended.

Under the condition that the half cylindrical portion 801' has been combined and incorporated with the half cylindrical portion 802' and they have been fitted in the lead cartridge 207, the wide width engaging projection 807' and the engaging rib 808' are pressed against and engaged with the inner circumferential surface of the lead cartridge 207. In the engagement state, a sufficient fitting pressure is obtained particularly by means of the wide width engaging projection 807' between the inner circumferential surface of the lead cartridge 207 and this engaging projection 807'.

As a result, said chuck type opening and closing mechanism 208 can be stably fitted and connected by means of such sufficient fitting pressure as described above.

Elastic opening and closing piece portions 284 and 285 are integrally aligned on the extreme ends of the half cylindrical portions 801' and 802', respectively.

These elastic opening and closing piece portions 284 and 285 have been previously deformed plastically (elastically) by each angle 0-towards the inside along the diametrical direction thereof as in FIG. 36 wherein either of the elastic opening and closing piece portions 284 and 285 is shown.

In these circumstances, when the elastic opening and closing piece portions 284 and 285 are strongly pressed into contact with each other in assembly and incorporation of them, both the elastic opening and closing piece portions 284 and 285 can be tightly assembled and incorporated.

Figure 26:
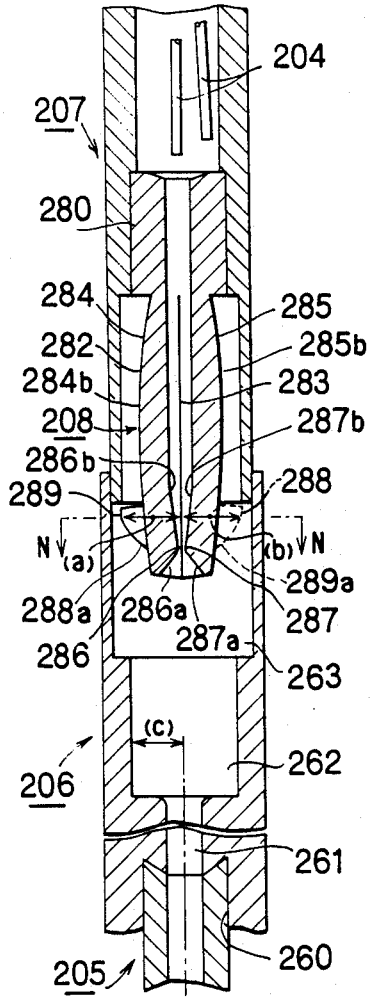
FIG. 26 is a sectional view showing essential parts for attaching a lead cartridge in a mechanical pencil before assembling the parts.
Figure 27:
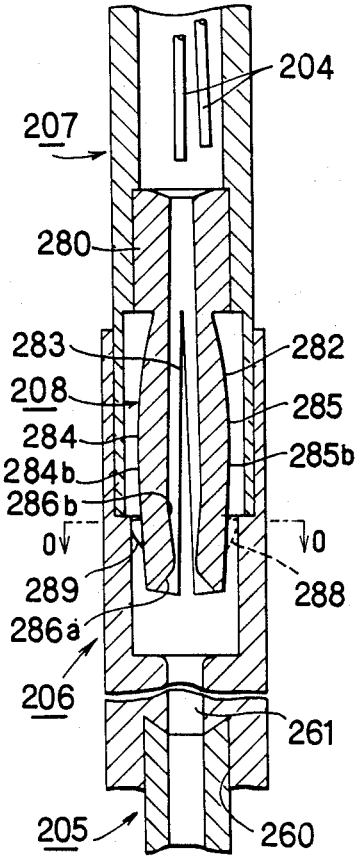
FIG. 27 is a sectional view showing the essential parts for attaching a lead cartridge after assembling them.
Figure 28:
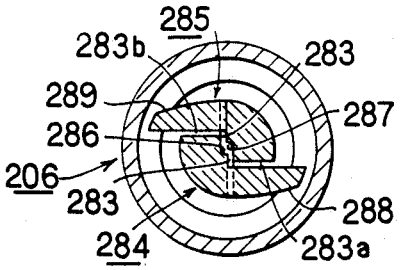
FIG. 28 is a sectional view taken along the line N—N of FIG. 26.
Figure 29:
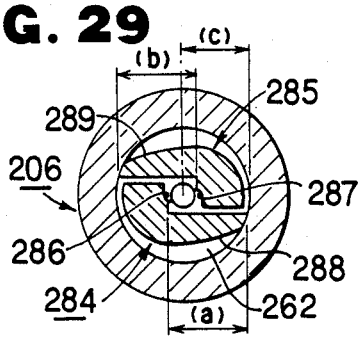
FIG. 29 is a sectional view taken along the line O—O of FIG. 27.
Figure 32:
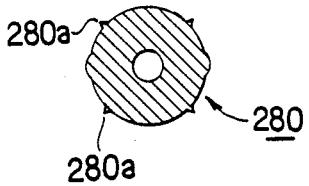
FIG. 32 is a sectional view taken along the line Q—Q of FIG. 30.
Figure 30:
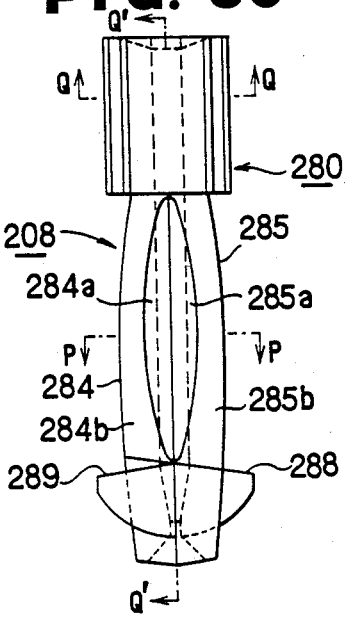
FIG. 30 is a side view showing a chuck type opening and closing mechanism according to the fourth example of the present invention.
Figure 33:
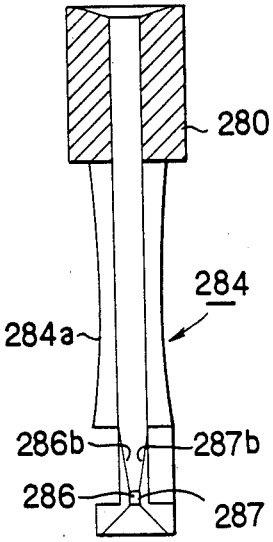
FIG. 33 is a sectional view taken along the line Q'—Q' of FIG. 30.
Figure 31:
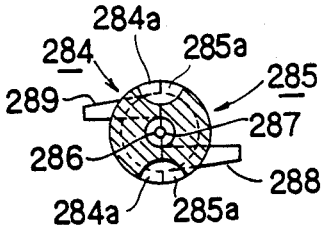
FIG. 31 is a sectional view taken along the line P—P of FIG. 30.
Figure 35:
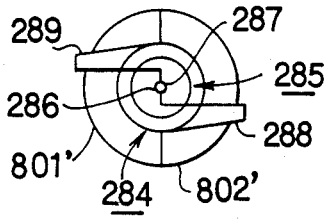
FIG. 35 is a left side end view of FIG. 34.
Figure 38:
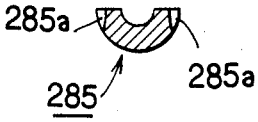
FIG. 38 is a sectional view taken along the line R—R of FIG. 37.
Figure 39:
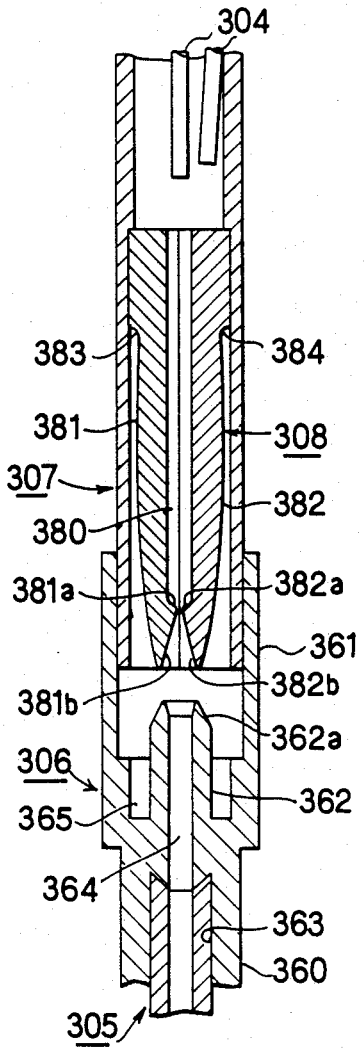
FIG. 39 is a sectional view showing essential parts for attaching a lead cartridge in a mechanical pencil before assembling the parts.
Figure 40:
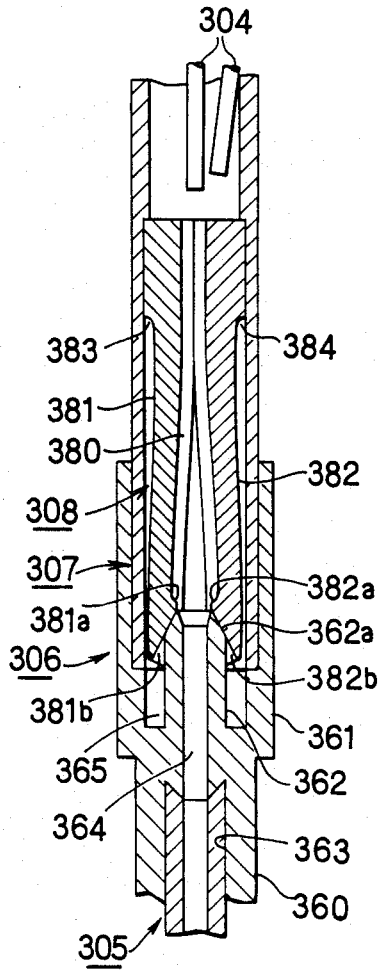
FIG. 40 is a sectional view showing the essential parts for attaching a lead cartridge after assembling them.

Consequently, when outward engaging piece portions 288 and 289 formed integrally on the front end sides of said elastic opening and closing piece portions 284 and 285 and which extend to the opposite sides in the diametrical directions, respectively, as shown in FIGS. 34 and 35 are forcibly put in the lead guide 206 as shown in FIGS. 26–27, these outward engaging piece portions 288 and 289 move in relative directions (the inside along the diametrical directions), and the elastic opening and closing piece portions 284 and 285 move to the outside along the diametrical directions thereof together with the outward engaging piece portions 288 and 289, so that half lead conducting holes 286 and 287 are opened.

Under such condition, when the outward engaging piece portions 288 and 289 are drawn out from said lead guide 206, the elastic opening and closing piece portions 284 and 285 are returned flexibly to the inside along the diametrical directions thereof, so that the half lead conducting holes 286 and 287 are opened.

As described above, the elastic opening and closing piece portions 284 and 285 open and close the half lead conducting holes 286 and 287 by means of forcible insertion of the outward engaging piece portions 288 and 289 into the lead guide 206 as well as drawing them out from the lead guide 206. In this case, since the whole of the opening and closing mechanism 208 is split into two pieces as mentioned above, each radius of opening and closing motions in said elastic opening and closing piece portions 284 and 285 becomes larger so that these elastic opening and closing piece portions 284 and 285 are easily subjected to elastic deformation.

In addition, since said elastic opening and closing piece portions 284 and 285 have sufficient flexible returning force due to the plastic deformation which has been previously applied to the elastic opening and closing piece portions 284 and 285 inside along the respective diametrical directions as mentioned above, they are smoothly operated and as a result, the fatigue due to repetition of the opening and closing motions decreases.

Moreover, since the whole opening and closing mechanism 208 has been split into two pieces, said outer engaging piece portions 288 and 289 as well as the defined portions of the half lead conducting holes 286 and 287 on the front end sides of said elastic opening and closing piece portions 284 and 285 may be separately formed with standing on different levels at a right angle as shown in FIG. 35.

Thus, the half opening and closing mechanism 208 can simply be molded, besides the mating face of said half lead conducting holes 286 and 287 can also be tightly and positively joined to each other due to sufficient returning force of said elastic opening and closing piece portions 284 and 285, so that there is no slippage of the lead members 204 in the elastic opening and closing piece portions 284 and 285. The lead cartridge 207 also will not slip off and drop therefrom.

Next, the fifth example according to the present invention will be described hereinbelow by referring to FIGS. 39–47 wherein a chuck type opening and closing mechanism 308 is provided with a lead conducting hole 380 and composed of symmetrical chuck opening and closing members 381 and 382 the whole of which is divided into two pieces in the diametrical direction thereof along the shaft center of the lead conducting hole 380 as shown in FIGS. 39–47. It is, however, to be noted that although two-piece chuck opening and closing members 381 and 382 have been used in the present fifth example, of course, other members split into more pieces may also be employed.

Rear side fitting portions 383 and 384 each of which is in the form of a stepped larger diameter half cylinder are integrally formed on the respective rear end sides of said chuck opening and closing members 381 and 382.

Figure 1:
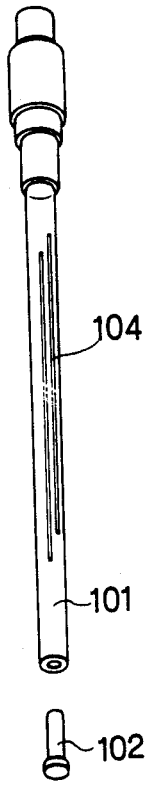
FIG. 1 (PRIOR ART)
FIG. 1 is a perspective view showing a conventional lead cartridge.
Figure 2:
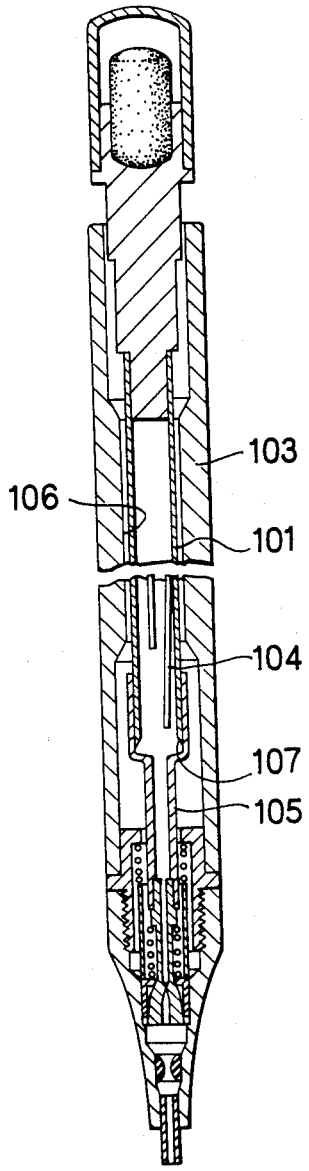
FIG. 2 (PRIOR ART)
FIG. 2 is a longitudinal sectional view showing a conventional such type of mechanical pencil.

Both of such chuck opening and closing members 381 and 382 as described above are combined and incorporated with each other, and the rear side fitting portions 383 and 384 thereof are fitted in and engaged with the lead cartridge 307 as shown in FIG. 1.

In this case, both of the rear side fitting portions 383 and 384 are constructed in such that they are positively engaged with and secured to each other in case of assembling and incorporating said chuck opening and closing members 381 and 382.

As the engaging means, an engaging convex portion 385 and an engaging concave portion 386 are integrally formed on either surface of the mating face composed of the rear side fitting portions 383 and 384, while an engaging concave portion 387 corresponding to the engaging convex portion 385 and an engaging convex portion 388 corresponding to the engaging concave portion 386 are integrally formed on the other surface of the mating face as shown in FIGS. 42–46.

Engaging ribs 386*a* and 387*a* are integrally extended from the inner wall surfaces of the engaging concave portions 386 and 387, while engaging grooves 385*a* and 388*a* for engaging the engaging ribs 386*a* and 387*a* therewith are defined on the side wall surfaces of the engaging convex portions 385 and 388.

Hence, when the engaging convex portion 385 and the engaging concave portion 386 on either rear side fitting portion 383 are fitted in the engaging concave portion 387 and the engaging convex portion 388 on the other rear side fitting portion 384, respectively, their engaging ribs 386*a* and 387*a* are engaged with the engaging grooves 385*a* and 388*a*, so that both the rear side fitting portions 383 and 384 are positively and securely engaged with and fixed to each other.

Thus, both of the rear side fitting portions 383 and 384 are exactly assembled and incorporated without any dislocation of them in the axial direction thereof, so that assemblage of the chuck type opening and closing mechanism 308 as well as fitting and setting thereof can be simply carried out with respect to the lead cartridge 307.

Furthermore, the rear side fitting portions 383 and 384 are constructed such that they are positively fitted in and engaged with the lead cartridge 307.

Figure 42:
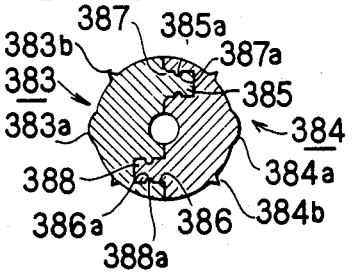
FIG. 42 is a sectional view taken along the line S—S of FIG. 41.
Figure 45:
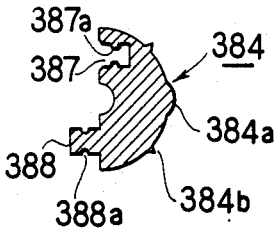
FIG. 45 is a sectional view taken along the line T—T of FIG. 44.
Figure 41:
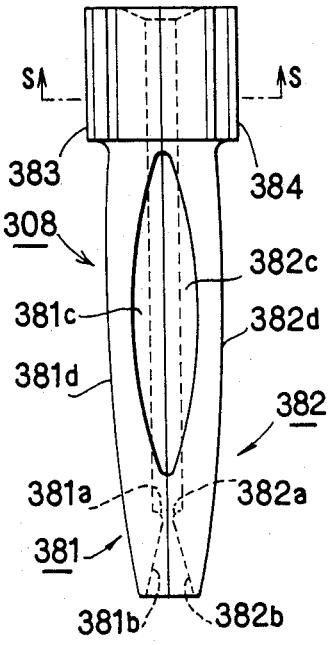
FIG. 41 is a side view showing an assembled state of a chuck type opening and closing mechanism.

The engaging means, wide width engaging projections 383*a* and 384*a* each having a semicircular arc in its profile and engaging ribs 383*b* and 384*b* are alternately and integrally extended from the outer circumferential surfaces of the rear side fitting portions 383 and 384 as shown in FIGS. 42 and 45.

Under the condition that the rear side fitting portions 383 and 384 are fitted in the lead cartridge 307, the wide width engaging projections 383*a* and 384*a* as well as the engaging ribs 383*b* and 384*b* are pressed against and engaged with the inner circumferential surface of the lead cartridge 307. In this engagement state, a sufficient fitting pressure is obtained particularly by means of the wide width engaging projections 383*a* and 384*a* between the inner circumferential surface of the lead cartridge 307 and this engaging projections 383*a* and 384*a*.

As a result, the chuck type opening and closing members 381 and 382 can be stably fitted and connected to the lead cartridge 307 in the assembled and incorporated state as mentioned above.

Inwardly projecting opening and closing portions 381*a* and 382*a* are integrally formed on the inner circumferential surfaces of the chuck opening and closing members 381 and 382 at the front side thereof. Tapered portions 381*b* and 382*b* are formed on the forward portons of the inwardly projecting opening and closing portions 381*a* and 382*a*, and each front end side of these tapered portions 381*b* and 382*b* are expanded so as to become gradually larger in diameter and are fitted and adjusted to a tapered portion 362*a* of a rear side inner cylindrical portion 362.

Moreover, the chuck opening and closing members 381 and 382 have an inward elastic force along a direction in which the inwardly projecting opening and closing portions 381*a* and 382*a* are closed, so that the former members are expandable and reducible.

Since the chuck type opening and closing mechanism 308 consists of a two-piece chuck opening and closing members 381 and 382, a lead conducting hole 380 is composed of half lead conducting holes 380*a* and 380*b*. These half lead conducting holes 380*a* and 380*b* are constructed so as to possess an inner diameter through which lead members 304 including those having different diameters can be conducted where said chuck opening and closing members 381 and 382 are elastically deformed towards the expanding direction. The inner diameter is also arranged so that a lead member 304 having the minimum diameter cannot be conducted by means of the inwardly projecting opening and closing portions 381*a* and 382*a* where said chuck opening and closing members 381 and 382 are elastically deformed towards the reducing direction.

So that both of the chuck opening and closing members 381 and 382 are tightly pressed into contact with each other by means of the inward elastic force during the assemblage and incorporation of them, the opening and closing members 381 and 382 are allowed to be elastically deformable in the expanding or reducing direction. Gouged portions 381*c* and 382*c*, each having a substantially semicircular arc in its profile, are defined on the outer circumferential surfaces in a mutual joint portion of the chuck opening and closing members 381 and 382 extending over both members as shown in FIGS. 41, 44, 46 and 47.

Furthermore, the outer circumferential surfaces of the chuck opening and closing members 381 and 382 are formed into curved portions 381*d* and 382*d* expanding outwardly between both gouged portions 381*c* and 382*c*.

Figure 44:
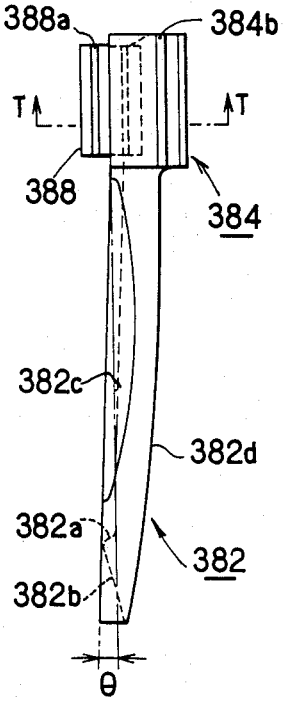
FIG. 44 is a side view showing only the under side chuck opening and closing member of FIG. 41.
Figure 46:
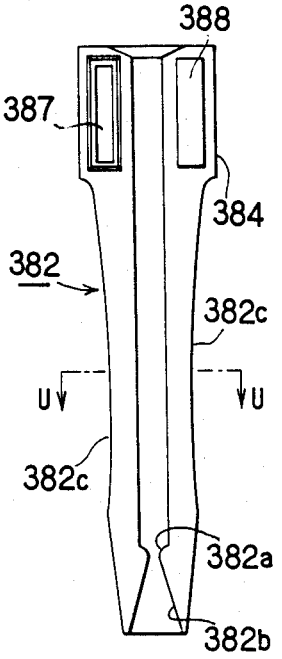
FIG. 46 is a plan view of FIG. 45.
Figure 43:
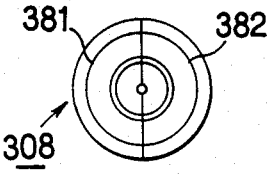
FIG. 43 is a left side end view of FIG. 41.
Figure 47:
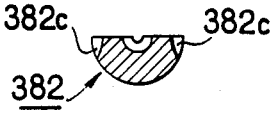
FIG. 47 is a sectional view taken along the line U—U of FIG. 46.

The jointed portion of the chuck opening and closing members 381 and 382 is thinned by means of said gouged portions 381*c* and 382*c*, and the outer circumferential surfaces 381*d* and 382*d* of the chuck opening and closing members 381 and 382 are formed into expanded curved surfaces 381*d* and 382*d*. Moreover, the chuck opening and closing members 381 and 382 have been previously deformed elastically by each angle 0-towards the inside along the diametrical direction thereof as shown in FIG. 44.

Under these circumstances, when the chuck opening and closing members 381 and 382 are strongly pressed into contact with each other by means of their inward elastic force in assembly and incorporation of them, both chuck opening and closing members 381 and 382 can be tightly assembled and incorporated. In addition, the elastic deformation of the chuck opening and closing members 381 and 382 towards the direction of expansion of the diameter while fitting them into the rear side inner cylindrical portion 362 of the lead guide 306 as well as the elastic deformation of the chuck opening and closing members 381 and 382 towards the direction of reducing the diameter in case of drawing them from the rear side inner cylindrical portion 362 are smoothly and positively performed. It is, however, to be noted that the gouged portions 381*c* and 382*c* are not indispensable elements for the present invention.

Under normal conditions, the chuck opening and closing members 381 and 382 are closed by means of an inward elastic force so that both of the half head conducting holes 380*a* and 380*b* define the minimum diameter during reduction of the diameter.

More specifically, two types of the opening and closing mechanisms according to the present example are constructed dependent upon the diameter or diameters of lead members 304 to be used.

(1) Use of the lead members 304 having the same diameter:

The half lead conducting holes 380*a* and 380*b* are opened so that a single type of lead member 304 each having one diameter, for example, 0.5 mm, 0.7 mm, 0.9 mm, only can be conducted through the resulting opening in the case when the tapered portions 381*b* and 382*b* on the extreme end of the chuck opening and closing members 381 and 382 are forcibly put in and engaged with the rear side inner cylindrical portion 362 of the lead guide 306.

(2) Use for both lead members having different diameters (for example, 0.5 mm and 0.7 mm):

The half lead conducting holes 380*a* and 380*b* are formed changeably so that they occupy a space through which either of the lead members 304 can be conducted during forcible insertion and engagement, while the half lead conducting holes 380*a* and 380*b* take a space through which both lead members having different diameters cannot be conducted while releasing the forcible insertion and engagement.

In operation, the lead cartridge 307 meshed with the lead guide 306 is drawn out together with the chuck type opening and closing mechanism 308 during exchange of lead members or confirmation of the presence of lead members during use of a mechanical pencil.

When both the chuck opening and closing members 381 and 382 are deformed elastically by means of their own inward elastic force in the direction of reduction of diameter, both the half lead conducting holes 380*a* and 380*b* are automatically closed until the closing diameter reaches that through which a lead member 304 cannot be conducted. In other words, when a lead member 304 having a diameter of 0.5 mm or more is used, both the holes are closed so as to have a closing diameter of 0.5 mm or less.

Thus, thee is no slippage of either the lead members 304 in the lead cartridge 307 from the end opening thereof to leave them in the outer cylinder 301. Also, the lead members 304 will not drop outside the outer cylinder 301.

Moreover, since there is no loss of lead members, it is not necessary to provide a beveled portion or a tapered portion on the extreme end inner surface of the lead cartridge 307. As a consequence, the flow of a resin does not become insufficient due to a thin thickness of the extreme end inner surface during molding of the lead cartridge 307 from a manufacturing point of view.

In addition, there is no need to provide an inside protuberant portion in the outer cylinder 301 as in a conventional mechanical pencil, and therefore the outer cylinder 301 may be obtained with inexpensive extrusion molding. Also, a diameter of the lead cartridge 307 can be made larger so that lead containing capacity can be significantly increased.

Furthermore, if a lead member 304 remains in an area extending over a lead feeding hole 364 of the lead guide 306 and the half lead conducting holes 380*a* and 380*b* of the chuck type opening and closing mechanism 308, this remaining lead member 304 is chucked with the inwardly projecting opening and closing members 381*a* and 382*a* of the chuck opening and closing members 381 and 382 to be drawn out, and the chucking operation being due to elastic deformation of the chuck opening and closing members 381 and 382 in the direction of reducing the diameter by means of removal of the opening and closing mechanism 308. Under these conditions, when either the lead member 304 is taken out from the half lead conducting holes 380*a* and 380*b* after the lead cartridge 307 is drawn out or the lead member 304 is pushed into the lead cartridge 307, there is no breakage of the remaining lead member 304 at the time of exchange of the lead cartridge 307, or clogging of the lead guide 306 with the broken lead member 304.

Thus, when a fresh lead cartridge 307 is pushed into the rear end of the outer cylinder 301, the tapered portions 381*b* and 382*b* on the extreme ends of the chuck opening and closing members 381 and 382 are forcibly fitted in the rear side inner cylindrical portion 362 of the lead guide 306 to be resiliently fitted and engaged. In this way the half lead conducting holes 380*a* and 380*b* of the chuck opening and closing members 381 and 382 are opened as mentioned above, so that supply of the lead members 304 becomes possible.

As described above, during exchange of the lead cartridge 307, the half lead conducting holes 380*a* and 380*b* are closed before the chuck opening and closing members 381 and 382 are inserted into the rear side inner cylindrical portion 362. Hence, there is no springing out of the lead members 304 from the lead cartridge 307 as in a conventional lead cartridge. Moreover, it is not necessary to invert a mechanical pencil while exchanging leads and to maintain the lead cartridge 307 in an upright position. Thus, the operation for exchanging the lead cartridge 307 can be carried out irrespective of the orientation of the mechanical pencil.

Particularly, the chuck type opening and closing mechanism 308, since a plurality of the chuck opening and closing members 381 and 382 are assembled and incorporated, and these chuck opening and closing members 381 and 382 have inwardly directed elastic force thereby are opened and closed in the diametrical direction thereof. Thus, a fresh lead cartridge 307 containing either lead members 304 each having identical diameters or lead members 304 having different diameters from one another is attached to the led guide 306 in accordance with the procedure mentioned above, whereby the lead members 304 can be supplied.

In other words, in the chuck type opening and closing mechanism 308, a degree of opening and closing for the chuck type opening and closing members 381 and 382 as well as the half lead conducting holes 380*a* and 380*b* is adjusted by means of its own elastic force, so that this opening and closing mechanism 308 can be used for the lead members 304 having identical diameters and lead members 304 having different diameters from one another.

According to the present invention, outward engaging piece portions are provided on a chuck type opening and closing mechanism which is divided into plural sections in the diametrical direction and has inward elastic force and which is disposed on the lead cartridge, and said outward engaging piece portions moving inwardly along the diametrical direction thereof to open lead conducting holes during forcible insertion into and engagement with a lead guide, while said outward engaging piece portions returning elastically to move outwardly along the diametrical direction thereof thereby to close the lead conducting holes during release for the forcible insertion and engagement. As a result, the lead conducting holes are opened when these outward engaging piece portions are resiliently fitted to and engaged with the lead guide. The lead conducting holes are closed when the outward engaging piece portions are not engaged with the lead guide. Thus, there is no springing out of a lead member from the lead cartridge during exchange. In addition, since a chuck type opening and closing mechanism is closed during exchange of the lead cartridge, the lead members remaining in a writing utensil can be drawn out.

In these circumstances, there is breaking of the said remaining lead members, or clogging of the writing utensil with broken lead members, so that the lead cartridge can be easily exchanged.

Moreover, a lead cartridge may contain either lead members having only the same diameter as the other, or lead members having different diameters from one another, because of the provision of the opening and closing mechanism according to the present invention. In addition, there are no parts to be thrown away such as a cap for conventional lead cartridge. Also, it is not necessary to provide a thick protuberant wall portion on the outer cylinder in the writing utensil according to the present invention. Hence, in the present invention, there are many excellent advantages such as the outer cylinder of a writing utensil may be formed by extrusion molding, and that the capacity for containing lead members in the lead cartridge can be increased.

Furthermore, according to the present invention, since a chuck type opening and closing mechanism is inserted and contained in the lead cartridge extending over substantially the whole length thereof, the appearance of the lead cartridge is improved. In addition, the lead cartridge does not need to be long because of the presence of the chuck type opening and closing mechanism, so that the shaft length of the mechanical pencil to which is applied can also be shortened.

In accordance with the present invention, a chuck type opening and closing mechanism mounted on a lead cartridge is composed of chuck opening and closing members each having an inward elastic force, and said chuck opening and closing members are obtained by dividing the chuck type opening and closing mechanism along the axis of the lead conducting holes in the diametrical direction thereof, so that the chuck opening and closing members can easily be molded. A construction of the molding die to be used may also be simplified, and as a consequence, the manufacturing cost for such writing utensils can significantly be reduced.

What is claimed is:

1. A lead cartridge opening and closing unit for a lead cartridge having an axis detachably fittable within a lead guide of a mechanical pencil in order to supply and/or exchange lead members, said opening and closing unit comprising:

a chuck type opening and closing mechanism mounted on said lead cartridge, said chuck type opening and closing mechanism being divided in a diametrical direction, relative to said axis, and having inward elastic force, said opening and closing mechanism being provided with elastic opening and closing piece portions the whole of which is divided in an axial direction of said mechanical pencil, these divided piece portions being coaxially combined and incorporated with each other, and said opening and closing piece portions being elastically deformable in the direction opposite to each other, said opening and closing piece portions defining a lead conducting hole therebetween, said lead conducting hole being open when said opening and closing piece portions are deformed opposite to each other and closed when said opening and closing piece portions are undeformed; and outward engaging piece portions provided on respective opening and closing piece portions, said outward engaging piece portions moving inwardly against said inward elastic force to elastically deform said opening and closing piece portions in the direction opposite to each other to open said lead conducting hole in case of forcible insertion into and engagement with said lead guide, said outward engaging piece portions returning elastically to move outwardly to close said lead conducting hole in case of release from said forcible insertion and engagement.

2. A lead cartridge opening and closing unit as claimed in claim 1 wherein engaging convex portions and respective engaging concave portions are formed on said opening and closing piece portions of said opening and closing mechanism, and said engaging convex portions and said respective engaging concave portions are provided for fitting to and engaging with one another in case of combination and incorporation thereof.

* * * * *